US005702054A

United States Patent [19]

Philips et al.

[11] Patent Number: 5,702,054

[45] Date of Patent: Dec. 30, 1997

[54] SINGLE PIECE FOOD PACKAGE

[75] Inventors: Nicholas A. Philips, West Chicago; Walter D. Keefe, Jr., Carol Stream, both of Ill.

[73] Assignee: Weyerhaeuser Company, Tacoma, Wash.

[21] Appl. No.: 652,890

[22] Filed: May 23, 1996

[51] Int. Cl.[6] ..... B65D 5/24

[52] U.S. Cl. ..... 229/110; 229/149; 229/906

[58] Field of Search ..... 229/109, 110, 229/149, 150, 902, 906

[56] References Cited

U.S. PATENT DOCUMENTS

| | | | |
|---|---|---|---|
| 2,900,122 | 8/1959 | Steiner | 229/149 |
| 5,000,374 | 3/1991 | Deiger | 229/109 |
| 5,358,173 | 10/1994 | Mertz | 229/906 |
| 5,402,929 | 4/1995 | Ritter et al. | 229/906 |
| 5,419,486 | 5/1995 | Bennett et al. | 229/109 |
| 5,452,845 | 9/1995 | Ritter | 229/906 |
| 5,535,940 | 7/1996 | Olds | 229/906 |

*Primary Examiner*—Gary E. Elkins

[57] ABSTRACT

A paperboard container is formed from a single piece with appropriate cuts, score lines and slots to become, when in the erected condition, a food container for holding food items such as pizzas. Top and bottom panels are provided as are appropriate side panels. Front angled corners are constructed where triangular panels and upstanding tabs create a receiving pocket for accepting the locking flap hinged to the top closure panel.

1 Claim, 1 Drawing Sheet

SINGLE PIECE FOOD PACKAGE

BACKGROUND OF THE INVENTION

In the field of food packaging, various food products are packaged for distribution in many different ways. Typically the packaging should be a relatively small portion of the overall price of the packaged food item while still providing safe and effective packaging and reasonably attractive shapes and graphics.

Over the years various paperboard products have been adapted for use as food packages. Single piece foldable paper blanks are often used to package all different kinds of food items. Well recognized will be, for example, paper ice cream cartons, paper milk cartons, corrugated shipping containers for holding produce, cans and the like, and others. Ordinary consumers will recognize that, for example, paper ice cream cartons are constructed from a single layer of paper material usually laminated with an appropriate plastic, likewise with paper milk cartons. For heavier duty packages a multi-layer corrugated containerboard is utilized.

The containers made from paper materials have certain characteristics in common, among them being their relatively low cost, their ease of cutting, scoring and slitting, their relatively light weight, and of more importance recently, their recyclability.

In the packaging of food items that are substantially round in nature, such as flat pizzas for carry out, it has become well accepted that corrugated multilayer paper materials can be utilized to form the package. Various structures have been proposed using corrugated shipping container material where flat blanks are cut, scored, slit and slotted in order to then be folded into a relatively flat, generally rectangular box for containing one or more pizzas. A typical example of such a container is illustrated in U.S. Pat. No. 4,765,534 issued Aug. 23, 1988 and assigned to Stone Container Corporation. Another example is illustrated in U.S. Pat. No. 5, 110,039 issued May 5, 1992 and assigned to Weyerhaeuser Company.

In addition to low cost, ease of formation, recyclability, and overall attractiveness, a container for containing carry out pizza must also have good insulating properties and be easy to fold from a flat condition into a folded up container. Another desired feature within a pizza container is suitable means for preventing sliding once the pizza is packaged. A reasonably tight fit is desirable to hold the pizza in place while it is being transported to the location for ultimate consumption. The top cover should also be lockable yet easily opened when ready to remove product.

Yet another desirable feature which relates directly to the overall cost of the package is to provide a container design that utilizes the least amount of paper material while providing the necessary functionality.

Accordingly, from the foregoing, one object of the present invention is the provision of a relatively low cost single piece food package.

Another object is to provide a single piece, easily erectable and recyclable paper food package.

Still a further object is to provide a single piece, relatively flat generally rectangular food container suitable for holding and retaining substantially round pizzas.

Still a further object is to provide means in the container for preventing sliding of the pizza once it is packaged within the container.

Yet another object is the provision of a receiving pocket for a lockable top.

These and other objects of the present invention will be well understood upon reading the specification to follow in conjunction with the attached drawings.

SUMMARY OF THE INVENTION

The present invention is practiced in one form by a single piece container made from paperboard which has a generally rectangular planer shape and is relatively short in the height dimension for containing food products such as generally round, carry out pizza. The container has generally rectangular top and bottom walls and four side walls. The front side wall is hinged to the bottom wall as is the back side wall. Two side walls are likewise hinged to opposed edges on the bottom wall. The top wall which forms the top lockable panel is hinged along the top edge of the back side wall. Extending outwardly from the two opposed side edges on the top wall are side flaps to which a hinged rear corner flap is attached. At each corner in the front of the container a special feature is provided to carry out the objects of the invention. Angled front corner panels are hinged to the side walls and to a triangular panel which is hingedly connected to the bottom panel and folded 180° to lay flat against a portion of the top surface of the bottom wall. A small inclined vertically extending corner tab is hinged to the end of the front wall and the triangular panel and together with the front wall and the front portion of the angled front corner panels forms a receiving pocket for accepting the locking flap hinged along the front edge of the top wall.

DETAILED DESCRIPTION OF THE PREFERRED EMBODIMENT

Figure 1:
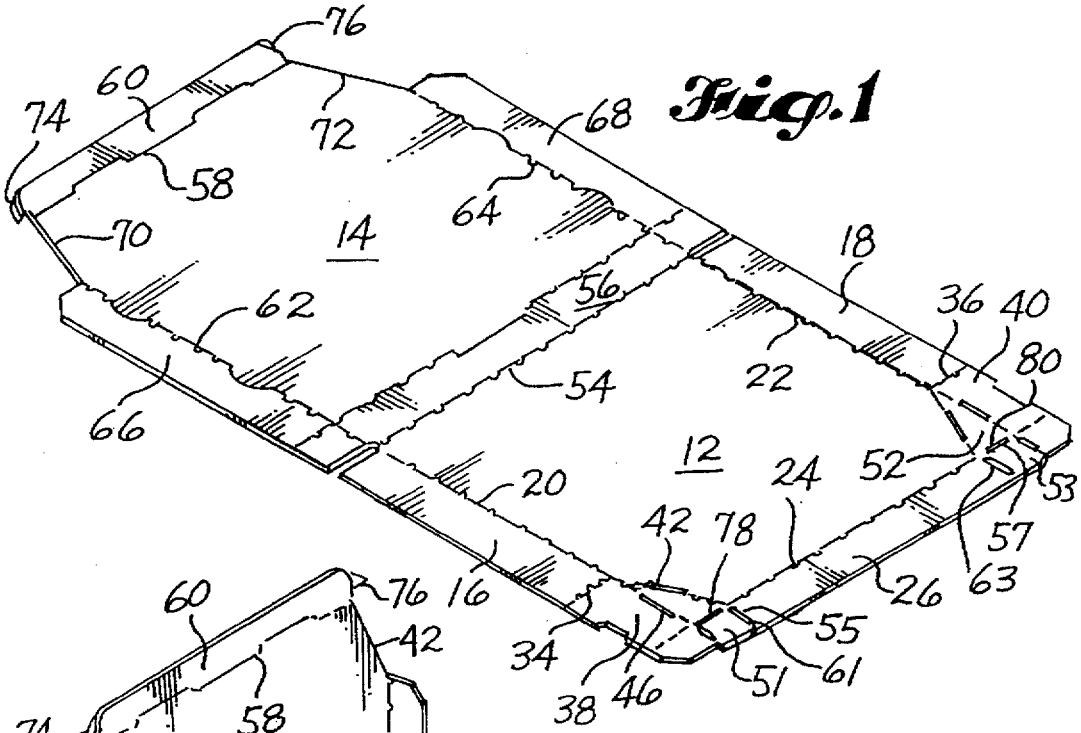
FIG. 1 is an isometric view illustrating a single piece flat blank, cut, scored and slotted according to the present invention.

Referring first to FIG. 1, the single piece cut, scored and slotted paperboard blank is indicated generally at 10. The blank 10 has a generally rectangular bottom wall or panel 12 and a corresponding top closure wall or panel 14. Extending outwardly and hinged thereto from the opposed side edges of bottom panel 12 are side walls 16, 18 along score lines 20, 22. Extending outwardly from score line 24 is a rectangular front wall or panel 26. Hinged to each end of side panels 16, 18 along respective score lines 34, 36 are rectangular front corner walls or panels 38, 40. A pair of hinge lines 42, 44 angle from the inner corners of the corner walls 38, 40 over toward the respective end points of score line 24. This is allowed by making the length of from panel 26 less than the overall width of bottom panel 12. Score lines 46, 48 are also created in blank 10 along a line extending linearly with score lines 20, 22 thereby forming a pair of opposed triangular shaped panels 50, 52. Attached to each triangular panel and the end of the front wall along the edge are corner tabs 51, 53; each via hinge lines 55, 57 along the triangular panels and hinge lines 61, 63 along each side edge of front wall 26. Each tab is rectangular and is severed from the adjacent portion of rectangular panels 38, 40.

Extending outwardly from hinge line 54 from the back edge of bottom panel 12 is the rear side or wall panel 56. Extending further outwardly from the top edge of panel 56 along hinge line 58 is the top, generally rectangular closure panel 14. The overall width of top panel 14 will be substantially equal to that of bottom panel 12 and the orthogonal dimension will be approximately equal to that same dimension of bottom panel 12. Extending outwardly from the edge of top panel 14 opposite hinge line 58 is a locking flap 60 which will be insertable into the receiving pocket, generally indicated at 59 in FIG. 2. As shown, there are laterally opposed hinge lines 62, 64 on either side of top panel 14 and depending therefrom are side flaps 66, 68. Opposed edges 70, 72 are angled inwardly and terminate at points which will establish a dimension for locking flap 60 which slightly shorter in length than the length of front side panel 26. A pair of hook members 74, 76 extend outwardly along each side edge of flap 60 and are sized so as to slide into and be removedly engaged by opposed slits 78, 80 located at each end of front panel 26.

Figure 2:
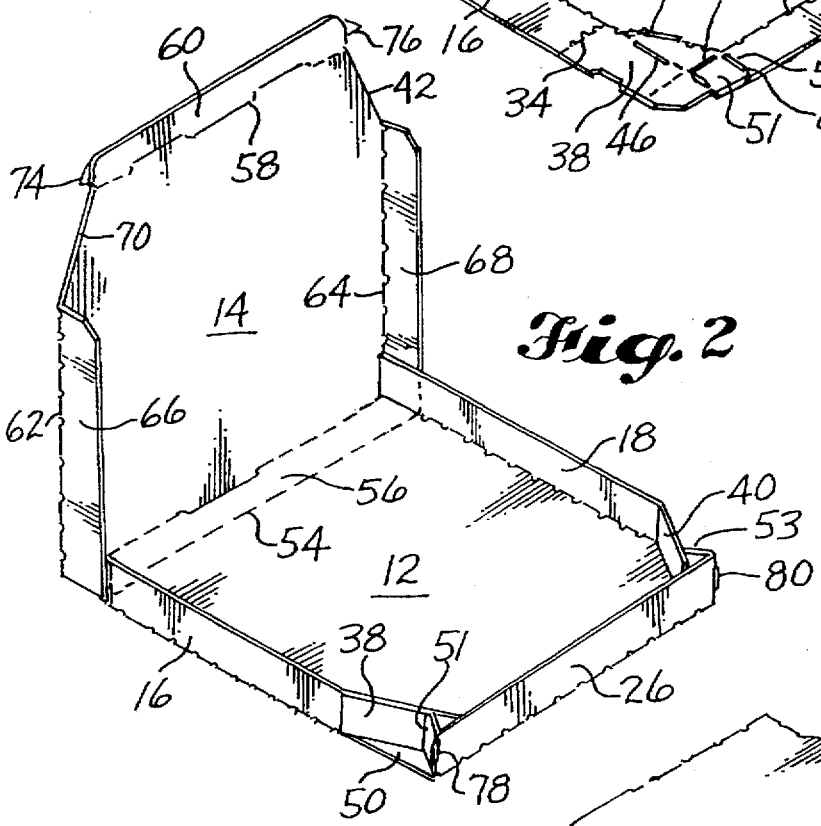
FIG. 2 is also an isometric view showing the single piece blank partially erected.
Figure 3:
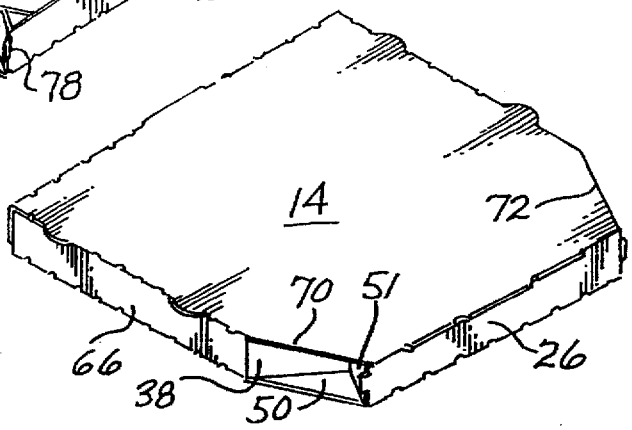
FIG. 3 is similarly an isometric view illustrating the front angled corner construction with the top wall locked in place.

Turning now to FIGS. 2 and 3, the folding sequence will be described for erecting a container from flat blank 10, packing a product and subsequently opening for removal of product. First, the angular front corner panels can be folded and moved into position while bringing the side walls up to form a bottom tray structure. First, as side walls 16, 18 are rotated 90° about their score lines 20, 22 each corner panel 38, 40 is pushed inwardly about its respective score line 34, 36. As this folding is progressing, each triangular panel 50, 52 is being rotated 180° about respective hinge line 42, 44 so that each panel 50, 52 then lies flat against the adjacent portion of bottom wall 12. Since each tab 51, 53 is attached to a triangular panel and an end of front wall 26, it too will be rotated about a folding axis to ultimately become a vertically extending panel inclined rearwardly with respect to the front wall which is rotated 90° in the folding process. With these panels now in place the bottom tray portion of the container is formed and results in the creation of receiving pocket 59.

At this point, with the tray formed, a pizza can be placed in the tray. Thereafter the rear panel 56 and top panel 14 will be rotated about their respective hinge lines to cover the product while simultaneously folding side flaps 66, 68 downwardly 90°. Finally locking flap 60 will be rotated about hinge line 58 and inserted into pocket 59. The hooks will engage the slits 78, 80 and lock the top in place.

Once the consumer is ready to remove the pizza the locking flap hooks will be released and the top opened.

The preferred embodiment of the present invention will be utilized to package "take out" pizza where the hot pizza will be retained within the closed container for transport while at the same time retaining as much heat as possible to keep the pizza hot. The locked cover will then be released to remove the pizza when ready for consumption.

While a detailed description has been provided of the present invention, modifications may occur to those skilled in the art. All such modifications are intended to be included within the scope of the appended claims.

We claim:

1. A single piece paperboard container for holding relatively flat circular food products has top and bottom walls with at least four side walls connected to respective edges of the top and bottom walls through hinge lines, having the improvement comprising:

a pair of angled corner structures on each corner of a front one of said side walls, each angled corner structure comprising:

a front corner wall connected to a side wall and extending at an acute angle inwardly toward the front one of said side walls, a triangular shaped panel hingedly connected to the bottom of the adjacent front corner wall and extending outwardly therefrom, a corner tab hingedly connected to an end of the triangular shaped panel and to the end of the front one of said side walls, a locking flap having opposed ends and extending outwardly from the front edge of the top wall, and a slit at the end of the front side wall adapted to receive a hook extending outwardly from the adjacent end of the locking flap.

* * * * *